United States Patent [19]

Harmsen et al.

[11] 4,399,545

[45] Aug. 16, 1983

[54] METHOD OF LOWERING ELECTRODES OF AN ELECTRIC-ARC FURNACE

[75] Inventors: Lothar Harmsen; Friedhelm Vennmann; Jürgen Zieschang, all of Lingen, Fed. Rep. of Germany

[73] Assignee: M.A.N. Maschinenfabrik Augsburg-Nürnberg, Fed. Rep. of Germany

[21] Appl. No.: 276,459

[22] Filed: Jun. 23, 1981

[30] Foreign Application Priority Data

Jun. 20, 1980 [DE] Fed. Rep. of Germany ..... 3023052

[51] Int. Cl.[3] ..... H05B 7/10

[52] U.S. Cl. ..... 373/94; 373/105

[58] Field of Search ..... 373/79, 81, 84, 94, 373/100, 105, 106

[56] References Cited

U.S. PATENT DOCUMENTS

| | | | |
|---|---|---|---|
| 2,365,521 | 12/1944 | Brooke | 373/105 |
| 2,485,094 | 10/1949 | Gundersen | 373/105 |
| 3,404,209 | 10/1968 | Brooke | 373/81 |
| 3,823,243 | 7/1974 | Vitale et al. | 373/105 |

*Primary Examiner*—Roy N. Envall, Jr.

*Attorney, Agent, or Firm*—McGlew and Tuttle

[57] ABSTRACT

A method of lowering graphite electrodes which are supported vertically displaceable electrode holders and extend through the cover of an electric arc furnace is disclosed. In accordance with the disclosed method, the furnace cover is completely laterally swung away from the furnace vessel and then the free lengths of the electrodes below the electrode clamps are adjusted to a position insuring a stable electric arc.

6 Claims, 9 Drawing Figures

METHOD OF LOWERING ELECTRODES OF AN ELECTRIC-ARC FURNACE

The invention relates to a method of lowering the electrodes of an electric-arc furnace, which are detachably clasped by vertically displaceable electrode arms.

As known, the electrodes of an electric-arc furnace are subjected to consumption, with the result that during a melting operation, the electrodes become continually shorter. Therefore, upon exhausting the feed stroke of the electrode arms, detachably clasping the electrodes, which is controllable as a function of the rate of consumption, the electrodes must be unclasped and lowered relative to the electrode arms, and then the electrode arms must again be fastened to the electrodes, to ensure a controlled further feeding of the electrodes during the following melting operation.

The electrodes may be lowered, for example, prior to charging the first basket filled with scrap, in a manner known per se. In such a case, first, the electrode arms are brought into their lowermost position, while the furnace cover remains in its closing position. Then, a crane is attached to the support of the electrode, so that this electrode can be unclasped. Thereupon, the electrode is lowered by means of the crane to predetermined level at which the correct spacing of the electrode tip from the bottom of the furnace vessel is reestablished. The respective electrode arm can then again be fixed to the electrode. The crane is now available for lowering the other electrodes.

The advantage of this method is the possibility of lowering the electrodes exactly. What is disadvantageous, however, is the great loss of time, since the furnace vessel is not open and, therefore, no charging is possible during the period of lowering the electrodes.

In practice, in order to reduce the time losses during lowering of the electrodes, it has been provided to lower the electrodes by means of a crane as soon as they have worked through the scrap and the electrode arms arrive at their lowermost position. This is provided particularly in instances where a single crane is available for an electric-arc furnace. In such a case, after engaging one electrode by the crane, the electrode is unclasped and the electrode arm is lifted through a distance which necessarily must be estimated by the operator. Upon reaching the level determined by the operator, the electrode arm is fastened to the electrode again and the procedure of lowering is repeated with the other electrodes.

A substantial disadvantage of this method is that it is left to the estimation of the operator alone how accurately the individual electrodes are lowered and brought to equal level with the other electrodes. For example, with an insufficient lowering, the electric arc becomes unstable because of the too large distance between the electrode tip and the material to be melted, which necessarily extends the time of melting and increases the power demand. On the other hand, if an electrode has been lowered too much, the brick lining of the hearth may easily be damaged.

Finally, to reduce the lowering time, it has been provided to lower the electrodes after charging the first basket of scrap, with arcs being established at all of the electrodes. Then, the electric-arc furnace is switched off and the electrodes are unclasped simultaneously or sequentially. Depending on the kind of clasping, the electrodes slide or fall downwardly until the electrode tips butt against the scrap. Thereupon, the electrode arms are moved upwardly through a distance which again can only be estimated by the operator. After reaching the selected level, the electrode arms are clamped to the electrodes again and the electric-arc furnace is switched on.

The lowering of electrodes with an abutment on the scrap does minimize the loss in operating time, it has the disadvantage, however, that the electrodes are adjusted very inaccurately relative to the melt. In addition, the electrode may become damaged relatively very rapidly if the electrode tips butt against obliquely extending, sharp-edged scrap parts.

SUMMARY OF THE INVENTION

The invention is directed to a method of lowering electrodes of an electric-arc furnace insuring an exact lowering of the electrodes without losing operating time and while eliminating the risk of damaging the electrodes.

To solve the problem, the the furnace cover is completely laterally swung away from the furnace vessel and then the free lengths of the electrodes below the electrode clamps are adjusted to a measure insuring a stable electric arc.

The essence of the invention is to create conditions for simultaneously carrying out operations which could hitherto be carried out only sequentially. The electrodes are now lowered with the furnace cover being swung out into its end position, i.e. into a position laterally of the furnace.

The swinging out of the furnace cover is anyway an operation which is necessary to make possible a charging. Consequently, the electrodes are lowered in the space laterally of the furnace vessel preferably during, i.e. simultaneously with, the charging of the first scrap basket. In view of the high costs of every minute of operation of an electric-arc furnace, operating time is saved by this work done simultaneously, with the result of an increased output.

Another advantage of the invention is that the lowering can now be effected absolutely exactly. To this end, a number of stops, namely supporting plates, corresponding to the number of electrodes is provided laterally of the furnace vessel, which can be adjusted sensitively, i.e. accurately, in their vertical position. An accurate vertical adjustment insures in turn an exact lowering of the electrodes which, as a rule, are consumed unequally. Fixed stops, namely supporting plates, adjusted to a single lowering level may be provided. Then, the burned off electrodes are lowered by means of the electrode arms until the electrode tips contact the stops. This lowering can be effected in an absolutely soft manner, so that no damages to the electrodes are to be expected. As soon as the electrodes are in contact with the stops, namely the supporting plates, the electrode arms are disengaged from the electrodes, moved upwardly most accurately through the predetermined distance, and clamped again to the electrodes.

This method may be applied particularly in instances where the construction of the furnace makes possible a downward movement of the electrode arms with the furnace cover in swung-out position. Also, the capital investment is reduced.

If there is no possibility of displacing the electrode arms with the furnace cover in swung-out position, the invention provides stops which are adjustable in height. In such a case, the stops in the form of supporting plates can be moved upwardly to softly apply against the electrode tips. Upon unclasping, the stops with the electrodes standing upright thereon are altogether lowered to the provided level of lowering. After reaching this predetermined level, the electrode arms are fixed again to the electrodes.

A device for lowering electrodes is detachably clasped in vertically displaceable electrode arms of an electric-arc furnace and comprises a swing-out cover through which the electrodes extend vertically, the inventive solution provides stops, in the form of supporting plates, which, with the furnace cover in swung-out position, are disposed below the electrodes and are also adjustable in height and arrestable at a predetermined level.

Such stops in the form of supporting plates provided laterally of the furnace vessel have the particular advantage of being widely independent of the heat zone of the electric-arc furnace. They may therefore, be of relatively simple design. If the stops are at a fixed level, for example, in the form of a supporting table, which is advantageous in furnace constructions where, with the furnace cover in swung-out position, the electrode arms can be moved downwardly, the capital investment is low, since no movable parts are to be provided.

If, with the furnace cover in swung-out position, it is not possible to move the electrode arms downwardly, the stops are designed as individual supporting plates which are vertically adjustable and arrestable in the predetermined level. The means for adjusting the stops are sensitivity controllable, so that the stops cannot butt harshly against the electrode tips and cause damages. In this connection, it is further possible to provide an automatic release of the sequential steps such as unclasping, relative displacement of the electrode arms, and clamping fast again, in response to the contact between the electrode tips and the stops, both with the locally fixed stops, namely a supporting table, and the vertically adjustable stops, namely supporting plates.

Accordingly, it is an object of the invention to provide a new and improved method of lowering graphite electrodes which are supported by vertically displaceable electrode holders and extend through the cover of an electric furnace.

For an understanding of the principles of the invention, reference is made to the following description of typical embodiments thereof as illustrated in the accompanying drawings.

BRIEF DESCRIPTION OF THE DRAWINGS

In the following, the invention is explained in more detail with reference to embodiments shown in the drawings. The drawings shown in diagrammatical or sectional views.

DETAILED DESCRIPTION

Figure 1:
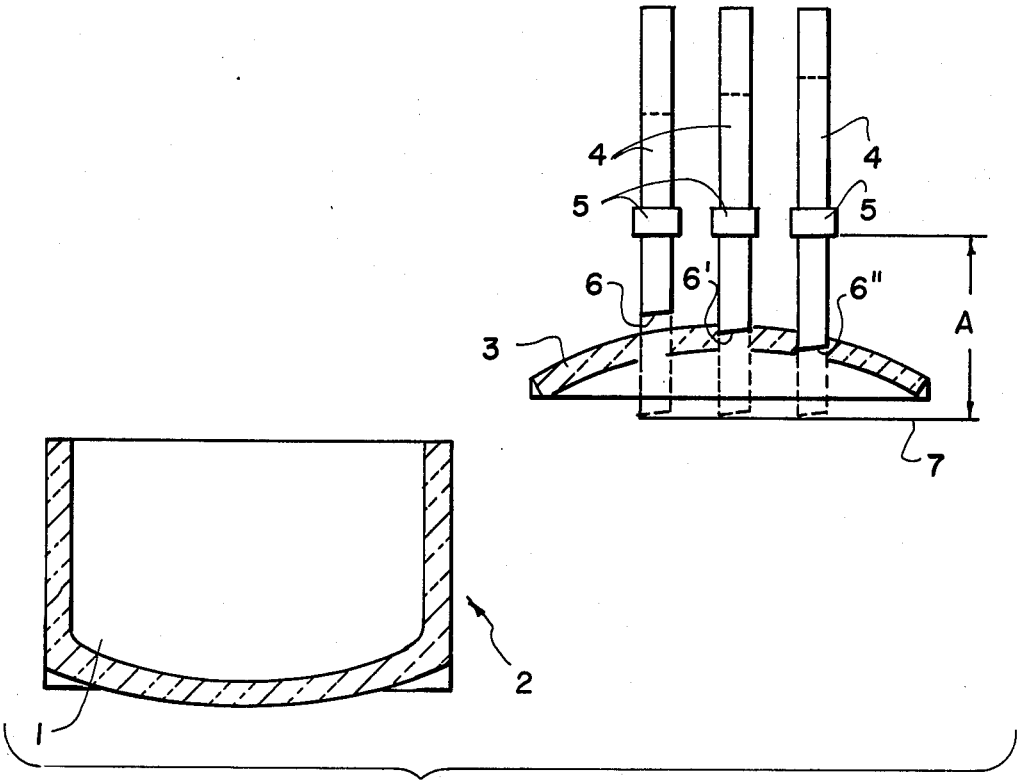
FIG. 1 an electric-arc furnace including a furnace vessel and a furnace cover in swung-out position, with electrodes which are burned off to different lengths, FIG. 2, the furnace cover in swung-out position, equipped with an elevating mechanism, with one of the three electrodes being suspended in the uppermost position by its hanger, FIG. 3, corresponding to FIG. 2, with the electrode shown after being lowered by the elevating mechanism through the desired distance, FIG. 4, the furnace cover in swung-out position and three unequally burned-off electrodes propped from below by individual supporting plates, FIG. 5, corresponding to FIG. 4, with the three electrodes being in a position lowered through the provided distance by moving the supporting plates downwardly to the predetermined equal level, with the electrode tips resting thereon, FIG. 6, the furnace cover in swung-out position, with the electrodes unequally burned off and a supporting table provided below, FIG. 7 corresponding to FIG. 6, with the electrodes clasped by the electrode arms being lowered to a position in which the electrode tips rest against the supporting table, FIG. 8 corresponding to FIG. 7, with the electrodes resting by their tips on the supporting table and the electrode clamps being disengaged and moved upwardly into positions of equal level, and FIG. 9 corresponding to FIG. 8, with the electrode arms with the electrodes clamped thereto again being moved upwardly through a predetermined distance, so that the furnace cover along with the electrode supporting mechanism is ready for being swung back to the furnace vessel.

FIG. 1 shows the furnace vessel 1 and the swung-out furnace cover 3 of an electric-arc furnace 2, in section. In order to explain the method clearly, the mechanisms and devices are shown only diagrammatically in all the figures.

Furnace vessel 1 is closable by a furnace cover 3 which is displaceable vertically by means which are not shown, and can be swung out horizontally about a vertical axis (not indicated).

Three electrodes 4 offset by 120° relative to each other extend vertically through furnace cover 3. Electrodes 4 are moved through supporting arms by an elevating and supporting mechanism (not shown) and they are detachably embraced by electrode clamps 5. With the furnace cover 3 in swung-out position, the electrode arms carrying the electrode clamps 5 are vertically displaceable. For the sake of clarity, the electrical connections to electrodes 4 through the electrode clamps, which usually include a clamping ring and contact jaws, are not shown either. FIG. 1 shows electrodes 4 as they look after some melting cycles and it is evident that due to the unequal consumption the electrode tips 6, 6′,6″ are burned off differently. In a lowering operation, the electrodes, which have unequal lengths as the result of the preceding consumption, are moved downwardly so as to bring their tips to a level indicated by a line 7.

Figure 3:
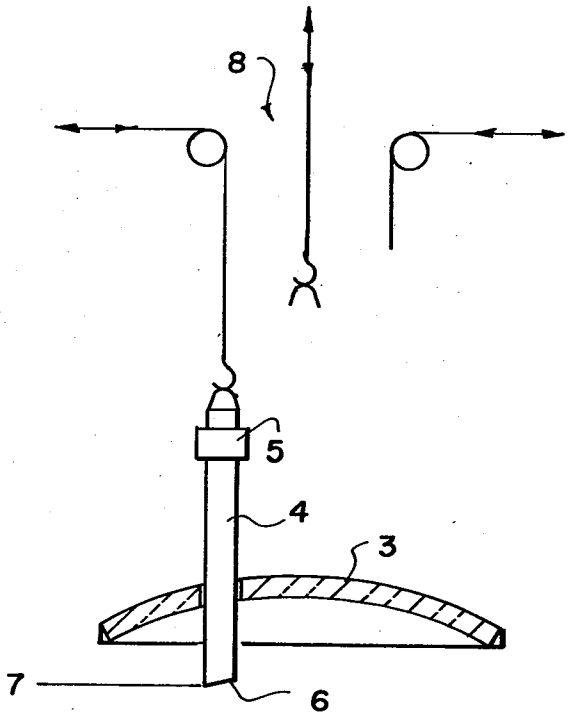
Figure 2:
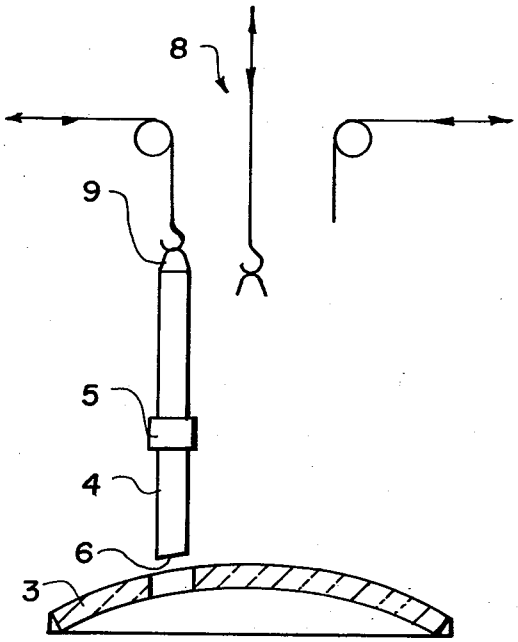

FIGS. 2 and 3 illustrate diagrammatically the lowering of electrodes 4 by means of an elevating mechanism 8, with the furnace cover in a fully swung-out position. Electrodes 4 are connected by hangers 9 provided on their upper end and suspension hooks to elevating mechanism 8 which is mounted in association with the position the electrodes occupy with the furnace cover swung out. Upon disengaging electrode clamps 5, the free end portions of electrodes 4 are lowered so as to obtain a predetermible length of their free end portion below electrode clamps 5. Electrode tips 6,6′,6″ come into a lower position at a common level corresponding to line 7.

After electrode clamps 5 have been reengaged with the electrodes, the elevating mechanism 8 is disconnected therefrom. While employing such an elevating mechanism, watching of electrode tips 6,6′,6″ and adjusting them to about the level of line 7 is still entrusted to the operator. However, the obtained advantage is that the length by which the electrodes extending through the swung-out furnace cover are to be lowered can be determined by the operator at a location off the furnace vessel and without being troubled by the heat.

Figure 5:
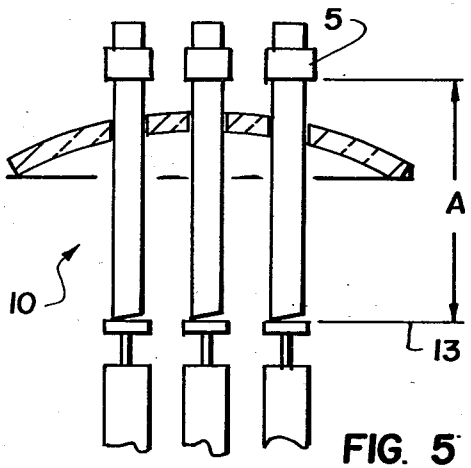
Figure 4:
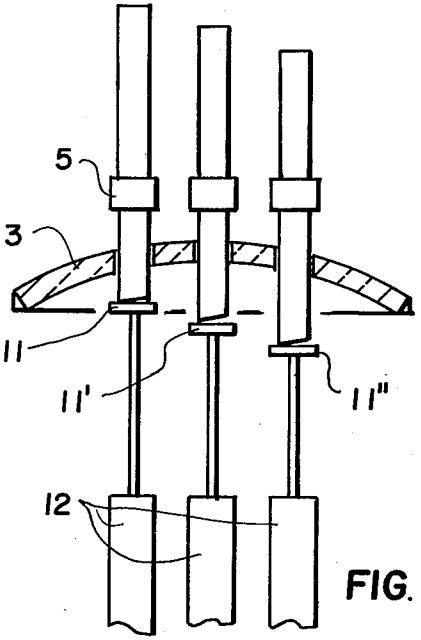

In the method of lowering electrodes diagramatically illustrated in FIGS. 4 and 5, a lowering device 10 comprising three mutually independent supporting plates 11, 11′ and 11″ with associated lifting elements 12 and control elements, is provided exactly in extension of the electrode axes of furnace cover 3 which is in its swung-out end position.

Upon swinging furnace cover 3 out into its end position for charging, the vertically adjusted supporting plates 11, 11′ and 11″ are moved through individual lifting elements 12 gently from below upwardly toward the electrodes, until they come into contact with the tips thereof.

As soon as supporting plates 11, 11′ and 11″ in the course of the upward motion come into contact with the electrodes and support them, electrode clamps 5 are disengaged. With electrode clamps 5 open, supporting plates 11, 11′ and 11″ along with the electrodes are now moved downardly into a predetermined position, namely the position of lowering 13, with supporting plates 11, 11′ and 11″ being lowered together with electrodes 4 standing upright thereon. Upon reaching the position of lowering 13 as shown in FIG. 5, electrode clamps 5 are reengaged. After the three electrode clamps have been clamped fast, the electrode arms with electrode clamps 5 and the electrodes clamped thereto are moved back into their upper initial position; supporting plates 11, 11′ and 11″ are moved back into their lowered position, so that upon termination of the charging operation, the furnace cover can be swung back into its position on top of the furnace vessel.

Since the electrode clamps are in their uppermost position and supporting plates 11, 11′ and 11″ with the electrodes are moved into the predetermined position of lowering 13, the adjusted electrode length A, i.e., the distance between the electrode tips 6 and the lower edge of electrode clamp 5, is constant for any melt, provided that the electrode has a sufficient length. The upward motion of supporting plates 11, 11′ and 11″ is stopped as soon as there is a small pressure on the lowering system, and damages to the electrodes are precluded.

Some furnace constructions allow a downward movement of the electrode arms with the furnace cover in swung-out position. In such furnace constructions, there is no need for providing plates which are vertically displaceable.

Figure 6:
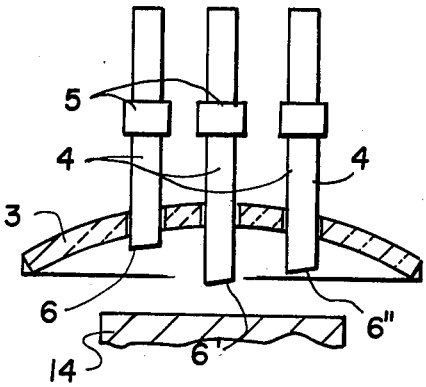
Figure 7:
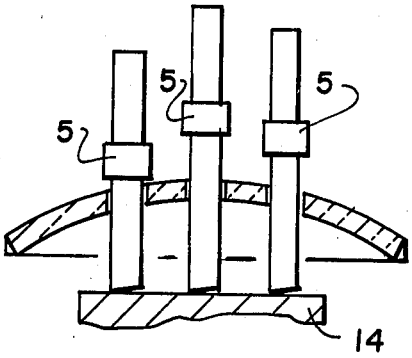

After swinging the furnace cover 3 out into its end position, the electrode arms along with clamps 5 engaging the electrodes are moved downwardly until electrode tips 6,6′,6″ come into contact with a supporting table 14. This is diagrammatically shown in FIGS. 6 and 7.

Figure 8:
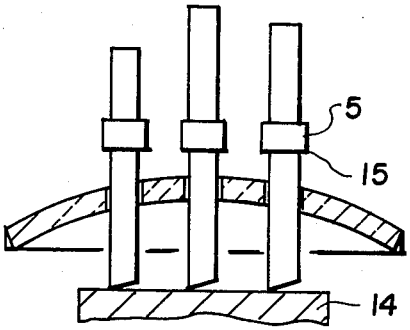
Figure 9:
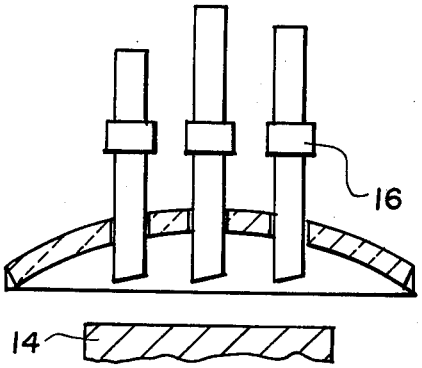

As soon as electrode tips 6 contact supporting table 14, the downward movement of the individual electrode arms carrying electrodes 4 clamped thereto is stopped and electrode clamps 5 disengage. With all three of the electrodes standing upright on supporting table 14 and clamps 5 disengaged, the electrode arms along with electrode clamps 5 are moved upwardly to a predetermined level, the level of lowering 15. This is illustrated in FIG. 8. Clamps 5 are then closed and the electrode arms with the electrode clamps firmly holding the electrodes are moved back into their uppermost position, in accordance with FIG. 9. Now, with the charging operation terminated, furnace cover 3 can be swung back.

The last two described methods differ in principle from each other in that according to FIGS. 4 and 5, the electrode tips which are burned off to different levels are approached from below with caution by individual supporting plates, while in the other case, due to a particular furnace construction, the electrode arms are capable of moving the electrodes into a lowermost position until the electrode tips, upon a cautious lowering, come to rest against the supporting table. Of course, a vertically fixed supporting plate may be provided for each electrode instead of the supporting table common for all of the electrodes.

The structures for setting the level of each electrode end shown in FIGS. 4–9 can be thought of as stop means for establishing a selected level for each electrode end which sets the free length of each electrode below each respective electrode clamp to an amount which insures a stable arc.

A detailed showing of the devices is intentionally omitted, since, for example, hydraulic cylinders or supporting columns vertically moved by a motor may be employed for the provided sensitive displacement of the supporting plates. The devices only must satisfy the two conditions of the reversible speed control. The upward motion must be made gentle and must be connected to an overload cutout by which the upward motion is stopped upon a contact with the electrode tips. The automatic downward motion must be limited to a lower position of lowering 13. Should the length of the electrode be no longer sufficient, the downward motion is controlled manually.

We claim:

1. A method of lowering graphite electrodes of the type having free lengths and electrode clamps clamped about the electrodes, the electrodes being supported by vertically displaceable electrode holders being extended through the cover of an electric-arc furnace, comprising the steps of, initially, laterally swinging the furnace cover completely away from the furnace and over stop means against which each electrode is engageable for setting a free length of each electrode below each electrode clamp to a length which insures a stable electric arc, disengaging the electrode clamps from the electrodes, and adjusting the free lengths of the electrodes below the electrode clamps to the lengths which insure a stable electric arc using the stop means.

2. A method according to claim 1, further comprising moving vertically adjustable supporting plates forming the stop means up into contact with the electrodes and after disengaging the electrode clamps, adjusting the free lengths of the electrodes resting against the supporting plates to the desired position by lowering the supporting plates, then again clamping the electrode clamps to the electrodes and bringing the supporting plates out of contact with the electrodes by further lowering the plates.

3. A method according to claim 1, wherein by means of the conventional holders, the electrodes clamped to the electrode clamps are initially lowered to a supporting table which is fixed at a selected level and forms the stop means, and then disengaging the electrode clamps and adjusting the free lengths by moving the electrode clamps upwardly relative to the electrodes, and then clamping the electrode clamps again to the electrodes.

4. A method of resetting the position of a plurality of graphite electrodes supported by respective vertically displaceable electrode holders each having an electrode clamp for clasping a respective electrode, with the electrodes extending vertically through a roof of an electric arc furnace having a furnace shell, comprising:

first swinging the furnace roof with the electrodes laterally completely away from the furnace shell and over stop means for establishing a selected level for lower ends of the electrodes; and thereafter with the roof and electrodes away from the furnace shell, adjusting a free length of each electrode below each respective electrode clamp to an amount which insures a stable arc and which corresponds to the selected level, each clamp being unclasped from said respective electrode at at least one point during said adjusting operation and the stop means being used to stop the lower ends of the electrode at the selected level.

5. A method according to claim 4, including a vertically displaceable supporting table for each electrode forming the stop means, said adjusting operation comprising moving each vertically displaceable support plate into engagement with a respective electrode, opening each electrode clamp of each respective electrode, lowering each respective supporting plate to adjust the free length of each electrode, reclasping each electrode with each respective electrode clamp, and further lowering each supporting plate away from each respective electrode.

6. A method according to claim 4, wherein said adjusting operation comprises providing a supporting table at a selected location corresponding to a desired free length of each electrode below each electrode clamp, which supporting table forms the stop means, moving each electrode using each respective electrode holder and electrode clamp into engagement with the support table, unclasping each electrode from its respective electrode clamp, moving each electrode clamp using each respective electrode holder upwardly to a clamping position above said operating table and reclasping each electrode with each respective electrode clamp.

* * * * *